US007748185B2

(12) United States Patent
Davis, II

(10) Patent No.: US 7,748,185 B2
(45) Date of Patent: Jul. 6, 2010

(54) MUNTIN GRIDS FOR TRANSPARENCIES AND TRANSPARENCIES HAVING MUNTIN GRIDS

(75) Inventor: William B. Davis, II, Fombell, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 251 days.

(21) Appl. No.: 11/847,582

(22) Filed: Aug. 30, 2007

(65) Prior Publication Data

US 2009/0056265 A1 Mar. 5, 2009

(51) Int. Cl.
*E06B 3/70* (2006.01)

(52) U.S. Cl. ..... 52/456; 52/204.595; 52/204.61; 52/204.62; 52/745.2

(58) Field of Classification Search ..... 52/204.5, 52/204.595, 204.599, 204.61, 204.62, 204.64, 52/204.65, 204.67, 204.71, 208, 314, 476, 52/698, 712, 715, 786.1, 786.13, 456; 24/297, 24/458; 403/297, 298; 428/34; 256/22, 256/34, 35

See application file for complete search history.

(56) References Cited

U.S. PATENT DOCUMENTS

| | | | | |
|---|---|---|---|---|
| 4,170,460 | A | 10/1979 | Donley | |
| 4,239,816 | A | 12/1980 | Breininger et al. | |
| 4,462,884 | A | 7/1984 | Gillery et al. | |
| 4,610,711 | A | 9/1986 | Matesa et al. | |
| 4,692,389 | A | 9/1987 | Gillery et al. | |
| 4,719,127 | A | 1/1988 | Greenberg | |
| 4,792,536 | A | 12/1988 | Pecoraro et al. | |
| 4,806,220 | A | 2/1989 | Finley | |
| 4,853,256 | A | 8/1989 | Obringer et al. | |
| 4,873,206 | A | 10/1989 | Jones | |
| 4,898,789 | A | 2/1990 | Finley | |
| 5,030,593 | A | 7/1991 | Heithoff | |
| 5,177,916 | A | 1/1993 | Misera et al. | |
| 5,234,199 | A * | 8/1993 | Cluff | 256/34 |
| 5,240,886 | A | 8/1993 | Gulotta et al. | |
| 5,313,761 | A | 5/1994 | Leopold | |
| 5,531,047 | A | 7/1996 | Leopold et al. | |
| 5,655,282 | A | 8/1997 | Hodek et al. | |
| 5,678,377 | A * | 10/1997 | Leopold | 52/656.9 |
| 5,873,203 | A | 2/1999 | Thiel | |
| 6,027,766 | A | 2/2000 | Greenberg et al. | |
| 6,115,989 | A * | 9/2000 | Boone et al. | 52/786.13 |

(Continued)

FOREIGN PATENT DOCUMENTS

DE 88 05 653 U1 6/1988

OTHER PUBLICATIONS

U.S. Appl. No. 11/847,574, filed Aug. 30, 2007, Rosskamp et al.

(Continued)

*Primary Examiner*—Richard E Chilcot, Jr.
*Assistant Examiner*—Theodore Adamos
(74) *Attorney, Agent, or Firm*—Andrew C. Siminerio

(57) ABSTRACT

A grid simulating muntins for a multi-sheet unit includes a plurality of interconnected vertical and horizontal elongated members. The ends of the elongated members are shaped to engage interior surface of a spacer frame to position the grid within the spacer frame. Shaping the ends of the elongated members eliminates the need for muntin clips.

14 Claims, 5 Drawing Sheets

U.S. PATENT DOCUMENTS

| | | | | |
|---|---|---|---|---|
| 6,244,012 | B1 * | 6/2001 | McGlinchy et al. | 52/665 |
| 6,935,078 | B1 * | 8/2005 | Benkel | 52/204.69 |
| 7,124,546 | B2 * | 10/2006 | Scharff et al. | 52/314 |
| 2004/0123557 | A1 | 7/2004 | Hornung et al. | |
| 2005/0028458 | A1 | 2/2005 | Rosskamp et al. | |
| 2005/0028459 | A1 | 2/2005 | Crandell et al. | |
| 2006/0026914 | A1 * | 2/2006 | Schultz | 52/204.61 |
| 2006/0029463 | A1 * | 2/2006 | Schultz et al. | 403/187 |
| 2006/0162282 | A1 * | 7/2006 | Schultz et al. | 52/786.13 |
| 2007/0261795 | A1 | 11/2007 | Rosskamp et al. | |

OTHER PUBLICATIONS

PCT International Search Report dated Feb. 27, 2009 for International Application No. PCT/US2008/074379 filed Aug. 27, 2008.

* cited by examiner

MUNTIN GRIDS FOR TRANSPARENCIES AND TRANSPARENCIES HAVING MUNTIN GRIDS

BACKGROUND OF THE INVENTION

1.) Field of the Invention

This invention relates to muntin grids for transparencies and to transparencies having muntin grids, and more particularly, to a grid simulating muntins having shaped ends to engage spacer frame between glass sheets of a multi-sheet unit to mount the grid within the spacer frame and between the glass sheets.

2.) Discussion of the Available Technology

Clips usually referred to as "muntin clips" are used to mount grids simulating muntins between adjacent sheets of a multi-sheet insulating unit, for example, as discussed in U.S. Pat. Nos. 5,313,761 and 6,115,989; United States Patent Publication Numbers US2004/0123557 and US2005/0028458A1 and in U.S. patent application Ser. No. 11/847,574 filed Aug. 30, 2007 in the names of Barent Rosskamp, Michael Buchanan, Stephen Crandell, William Davis and Cory Steffek and titled Retainer Clip for Grid Simulating Muntins (hereinafter also referred to as "U.S. patent application Ser. No. 11/847,574"). In general, but not limiting to the discussion, a multi-sheet insulating unit includes a glass sheet secured to each side of a spacer frame by a moisture and gas impervious adhesive-sealant to provide a sealed compartment between the sheets. The sealed compartment is usually filled with an insulating gas. The spacer frame in one embodiment of a multi-sheet insulating unit has a U-shaped cross section, e.g. as disclosed in U.S. Pat. No. 5,655,282. One of the features of the spacer frame having a U-shaped cross section is that the upright legs of the spacer frame are free to move toward and away from one another in unison with the glass sheets as the insulating gas in the compartment between the sheets expands and contracts due to pressure changes acting on the outer surfaces of the sheets.

The current practices of mounting a grid simulating muntins within the spacer frame, includes mounting the muntin clips on the ends of the grid, and mounting the clips on the interior surface of the spacer frame, or mounting the muntin clips on the interior surface of the spacer frame followed by mounting the ends of the grid on the muntin clips. United States Patent Application Publication Number US 2004/0123557 discloses a number of muntin clip designs. Although the present design of the muntin clips is acceptable for mounting grids simulating muntins between sheets of insulating units, there are drawbacks and/or limitations.

More particularly, many of the present muntin clips designs include a rigid base that bridges the two upright legs of the spacer frame maintaining the upright legs in a fixed relationship to one another. The drawback with this muntin clip design is that the muntin clip prevents portions of the upright legs and marginal edges of the sheets from moving toward one another as the pressure acting on the outside surface of the sheets increases. Another drawback with muntin clips having a rigid base is that during the pressing of the marginal edges of the sheets toward the outer surfaces of the space frame to flow the adhesive-sealant between the sheets and the spacer frame, the upright legs between adjacent muntin clips are flexible and move toward one another whereas the muntin clip is not flexible and prevents the upright legs at the position of the muntin clip from moving toward one another. The undesirable result is that the adhesive-sealant between adjacent muntin clips is thicker than the thickness of the adhesive-sealant at the position of the muntin clips. This drawback results in a "moisture sealant path" or "diffusion path" having a non-uniform thickness and can result in premature failure of the seal by allowing atmospheric air to diffuse into the sealed compartment. For a detailed discussion of the "diffusion path," reference can be made to column 13, lines 7-43 of U.S. Pat. No. 5,655,282 which patent is hereby incorporated by reference.

Another limitation with having the base of the muntin clip supported on and spanning the upright legs of the spacer frame is that the muntin clip is in the sight line of the insulating unit. Therefore, care has to be taken to make certain that the ends of the grid simulating muntins is flush with the base to avoid any space, or minimize the space, between the ends of the grid and the base of the muntin clip. Noticeable separations between the base of the clip and the end of the grid are aesthetically unacceptable.

U.S. patent application Ser. No. 11/847,574 discloses a muntin clip that eliminates the above drawbacks. More particularly, the muntin clip of U.S. patent application Ser. No. 11/847,574 has a spacer-engaging member having bendable walls that are positioned between the upright legs of the spacer frame with the end of the grid simulating muntins below the sight line of the unit. Although the muntin clip of U.S. patent application Ser. No. 11/847,574 eliminates the above discussed drawbacks, the muntin clips of U.S. patent application Ser. No. 11/847,574 have limitations. More particularly, muntin clips are required to secure the grid within the spacer frame. As is appreciated by those skilled in the art, the open ends of the horizontal and vertical members of the grids simulating muntins have different dimensions requiring an inventory of different size muntin clips for the different size end openings of the horizontal and vertical members.

As is appreciated by those skilled in the art, it would be advantages to provide a grid simulating muntins that does not require the use of muntin clips and provides the benefits of the muntin clips of U.S. patent application Ser. No. 11/847,574. Further as will be appreciated by those skilled in the art and as discussed in the Description of the Invention, the technology disclosed in the following patents can be used in the practice of the invention: U.S. Pat. Nos. 4,873,206; 4,792,536; 5,030,593; 5,240,886; 4,170,460; 4,239,816; 4,462,884; 4,610,711; 4,692,389; 4,719,127; 4,806,220; 4,853,256; 4,898,789; 5,873,203; 6,027,766; 6,027,766; 5,177,916; 5,655,282, and 5,531,047, and U.S. Published Patent Application No. U.S. 2005/0028458. Still further, the technology disclosed in copending U.S. Patent Application Ser. No. 11/696377 filed Apr. 4, 2007 can be used in the practice of the invention.

SUMMARY OF THE INVENTION

This invention relates to a grid simulating muntins of the type having a first plurality of spaced elongated members connected to a second plurality of elongated members, wherein in one non-limiting embodiment of the invention one of the elongated members of the first plurality of elongated members includes a first side having an outer surface; a second side opposite the first side, the second side having an outer surface facing away from the outer surface of the first side; a first end, and an opposite second end. The first and second sides at the first end each have an end part, wherein the end part of the first side is angled toward the outer surface of the first side and the end part of the second side is angled toward the outer surface of the second side, and ends of the end parts of the first and second sides at the first end of the one of the elongated members are each shaped to have a ledge.

The invention further relates to a multi-sheet unit having the grid of the invention simulating muntins. In one on-limiting embodiment of the invention, the multi-sheet unit includes a spacer frame having a base, a pair of legs extending from the base toward an interior of the spacer frame, and an interior side facing interior of the spacer frame; a pair of sheets, wherein the spacer frame is between the sheets and the sheets are mounted on an outer surface of the pair of legs. The grid simulating muntins is in the interior of the spacer frame between the sheets, the grid includes a first plurality of spaced elongated members, and a second plurality of spaced elongated members. Each of the first plurality of elongated members and each of second plurality of elongated members includes a first side having an outer surface; a second side opposite the first side, the second side having an outer surface; a first end, and an opposite second end, the first and second sides at the first end each have an end part, wherein the end part of the first side and the end part of the second side are each angled toward the second end, the outer surface of the first side on the end part of the first side in facing relationship to the outer surface of the second side on the end part of the second side, and the ends of the end parts of the first and second sides at the first end are each shaped to have a ledge, and the first side and the second side at the second end each have an end part, wherein the end part of the first side and the end part of the second side at the second end are each angled toward the first end, the outer surface of the first side on the end part of the first side at the second end in facing relationship to the outer surface of the second side on the end part of the second side at the second end, and the ends of the end parts of first and second sides at the second end are each shaped to have a ledge.

The ledge of the end part of the first side and the ledge of the end part of the second side at the first end of each of the first plurality of elongated members engages a first length of the interior side of the spacer frame, and the portion of the end part of the first side and of the second side at the first end of the first plurality of elongated members is between the interior side and inner surface of the base of the spacer frame; the ledge of the end part of the first side and the ledge of the end part of the second side at the second end of each of the first plurality of elongated members engages a second length of the interior side of the spacer frame, the second length opposite to the first length, and the portion of the end part of the first side and of the second side at the second end of the first plurality of elongated members is between the interior side and the inner surface of the base of the spacer frame; the ledge of the end part of the first side and the ledge of the end part of the second side at the first end of each of the second plurality of the elongated members engages a third length of the interior side of the spacer frame, and the portion of the end part of the first side and of the second side at the first end of the second plurality of elongated members is between the interior side and the inner surface of the base of the spacer frame, and the ledge of the end part of the first side and the ledge of the end part of the second side at the second end of each of the second plurality of elongated members engages a fourth length of the interior side of the spacer frame, the fourth length opposite the third length, and the portion of the end part of the first side and of the second side at the second end of the second plurality of elongated members is between the interior side and the inner surface of the base of the spacer frame.

The invention still further relates to a method of making a grid simulating muntins. In a non-limiting embodiment of the invention the method includes providing a first plurality of elongated members and a second plurality of elongated members, each of the elongated members having a first side, a second side, a third side and a fourth side with the first side and the second side opposite to one another, the third side opposite to the fourth side opposite to one another and between the first and second sides, a first end and an opposite second end; removing a portion of the third side and the fourth side at the first end of one of the plurality of elongated members defined as a first elongated member to provide the first side with an end part and the second side with an end part at the first end of the first elongated member; bending the end part of the first side at the first end toward the second end of the first elongated member, and bending the end part of the second side at the first end toward the second end of the first elongated member; shaping free end of the end part of the first side to form a ledge and free end part of the second side to form a ledge, and joining the first and second plurality of elongated members to form the grid simulating muntins.

DESCRIPTION OF THE INVENTION

Figure 1:
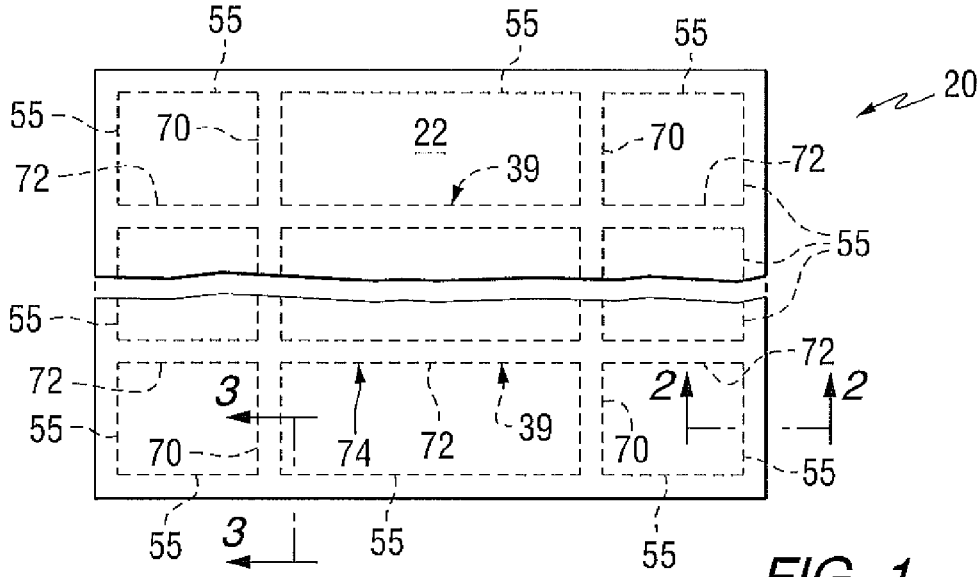
FIG. 1 is a plan view of a multi-sheet unit incorporating features of the invention.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "mounted over", "positioned over", or "provided over" mean mounted, positioned, or provided on but not necessarily in surface contact with. For example, one article "provided over" another article does not preclude the presence of materials between the articles.

Before discussing non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise, in the following discussion like numbers refer to like elements.

In general, the non-limiting embodiments of the invention include, but are not limited to, securing grids simulating muntins between sheets, e.g. adjacent sheets, of multi-sheet units without the use of muntin clips by shaping the ends of the horizontal and vertical members of the grid in accordance to the teachings of the invention. The term "multi-sheet unit" is usually used to mean a unit having two or more sheets in spaced relationship to one another, and the term "multi-sheet insulating unit" is usually used to mean a unit having two or more sheets in spaced relationship to one another and a compartment or space between adjacent sheets in which there is an insulating gas and preferably no or limited ingress or egress of gas into and/or out of the compartment, usually referred to as a "sealed compartment." In the following discussion, the term "multi-sheet unit", unless indicated otherwise, is used to mean a "multi-sheet unit" and a "multi-sheet insulating unit."

As can be appreciated, the practice of the invention is not limited to a multi-sheet unit and can be practiced on a transparency having only one sheet, with the one sheet secured to one side of a spacer frame; no sheet secured to the opposite side of the spacer frame, and the grid of the invention simulating muntins mounted within the spacer frame.

Figure 2:
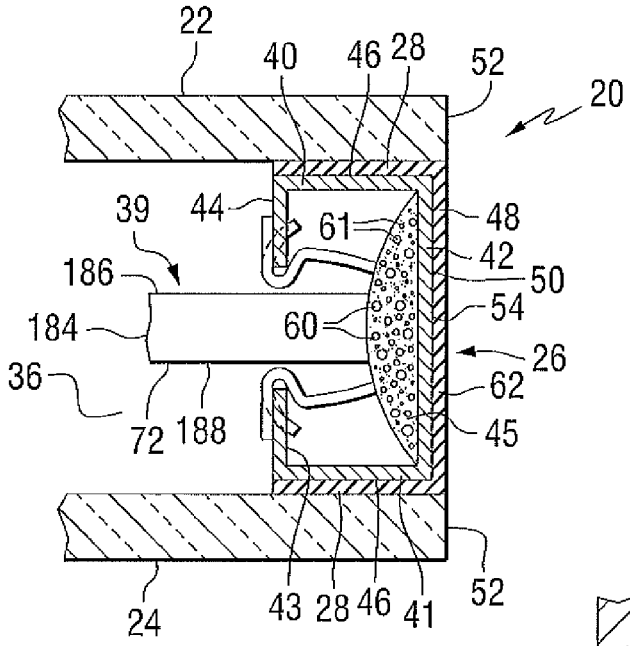
FIG. 2 is a view taken along lines 2-2 of FIG. 1.
Figure 3:
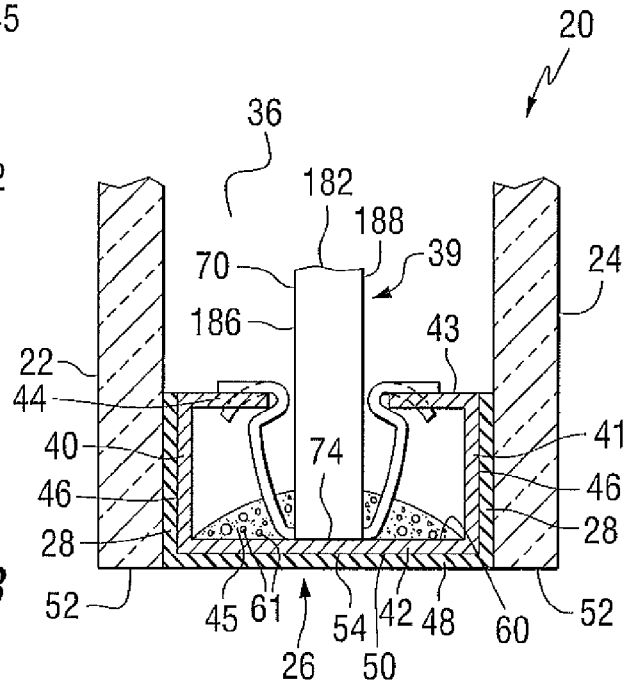
FIG. 3 is a view taken along lines 3-3 of FIG. 1.

FIG. 1 shows a multi-sheet unit 20 incorporating features of the invention, and FIGS. 2 and 3 show cross sectional views of the multi-sheet unit 20. The unit 20 has a pair of outer sheets 22 and 24 secured to a spacer frame 26 by a layer 28 of an adhesive or moisture impervious adhesive-sealant to provide a compartment 36 between the sheets 22 and 24. Preferably, but not limiting to the invention, the compartment 36 is sealed against the egress and ingress of the atmosphere outside the compartment, e.g., gases, moisture and/or dust (hereinafter individually and collectively referred to as "environmental atmosphere") by the layers 28 of the adhesive sealant discussed in more detail below. A grid 39 simulating muntins and incorporating features of the invention is provided in the compartment 36, i.e. within the spacer frame 26, between the sheets 22 and 24 in accordance to the teachings of the invention.

The invention is not limited to the material of the sheets 22 and 24 of the multi-sheet unit 20 of the invention, and the sheets can be made of any transparent material, e.g. glass, plastic and combinations thereof, and the selection of the material of the sheets is not limiting to the invention. Still further, the two or more sheets of the multi-sheet unit can be made of the same material or the sheets can be made of different materials. In addition, one sheet can be a monolithic sheet, and the other sheet can be a laminate, e.g. a transparency made of one or more monolithic sheets laminated together in any usual manner. One or both of the glass sheets of the unit can be uncoated and/or coated, and/or one or both of the sheets can be colored and/or clear sheets. For example and not limiting to the invention, the colored sheets can be of the type disclosed in U.S. Pat. Nos. 4,873,206; 4,792,536; 5,030,593 and 5,240,886, which disclosures are hereby incorporated by reference. Further, one or more of the surfaces of one or more of the sheets can have a coating to selectively pass predetermined wavelength ranges of light and energy, or one of the sheets can be opaque, e.g. made of an opaque material, e.g. metal, or can be transparent sheets having an opaque coating of the type used in making spandrels. Coatings of the type that can be used in the practice of the invention include but are not limited to the types disclosed in U.S. Pat. Nos. 4,170,460; 4,239,816; 4,462,884; 4,610,711; 4,692,389; 4,719,127; 4,806,220; 4,853,256 and 4,898,789, which disclosures are hereby incorporated by reference. Still further, in the practice of the non-limiting embodiments of the invention, one or more of the surfaces of the sheets can have a photocatalytic film or water reducing film, e.g. of the type disclosed in U.S. Pat. Nos. 5,873,203; 6,027,766, and 6,027,766, which disclosures are hereby incorporated by reference. It is contemplated that the photocatalytic film and/or the water reducing film can be applied or deposited on the outer surface of one or both of the sheets 22 and 24 of the multi-sheet unit 20.

The glass sheets 22 and 24 preferably have the same peripheral configuration and dimensions; however, as can be appreciated, one outer glass sheet can be larger than the other outer glass sheet. Further, the outer sheets 22 and 24 can have different peripheral configurations.

With continued reference to FIGS. 2 and 3, in the non-limiting embodiment of the invention under discussion, the spacer frame 26 has a pair of spaced outer legs 40 and 41 secured to a base 42 to have a generally U-shaped cross sectional configuration. Each of the outer legs 40 and 41 have a ledge or extension 44 and 43, respectively, extending toward one another over inner surface 45 of the base 42. The layer 28 of adhesive is provided on outer surface 46 of the legs 40 and 41 of the spacer frame 26 to secure the outer sheets 22 and 24 to the legs 40 and 41, respectively, of the spacer frame 26 to seal the compartment 36 against movement of environmental atmosphere into and out of the compartment. The layer 28 is preferably a moisture-impervious adhesive-sealant of the type used in the art to seal compartments of insulating units, and includes but is not limited to, butyls, silicones, polyurethane adhesives, and butyl hot melts of the type sold by PPG Industries, Inc. e.g. PRC591 SB. For a more detailed discussion of materials that can be used in the practice of the invention, but not limited thereto, reference is made to U.S. Pat. Nos. 5,177,916 and 5,655,282; U.S. Published Patent Application No. U.S. 2005/0028458 and U.S. patent application Ser. No. 11/696,377 filed Apr. 4, 2007 which documents are hereby incorporated by reference.

A layer 48 of an adhesive, sealant or adhesive-sealant can be provided on outer surface 50 of the base 42 of the spacer frame 26. Preferably the outer surface 50 of the base 42 is recessed inwardly from the peripheral edges 52 of the outer sheets 22 and 24 as viewed in FIGS. 2 and 3 to provide a channel 54 to receive the adhesive layer 48. The layer 48 can be a material similar or dissimilar to the material of the layers 28. As can be appreciated by those skilled in the art, the material of the layer 48 is preferably non-tacky after setting or drying so that the peripheral edges of the multi-sheet unit 20 do not stick to surfaces supporting the edge of the unit, especially during shipping and storage of the unit.

The spacer frame 26 can be made of any material e.g., wood, plastic, metal coated plastic, metal (e.g., stainless steel, galvanized steel or tin coated steel), aluminum and combinations thereof. Types of spacer frames and spacer stock that can be used in the practice of the invention, but not limited thereto are disclosed in U.S. Pat. Nos. 5,177,916, and 5,655,282 and U.S. patent application Ser. No. 11/696,377 filed Apr. 4, 2007.

Figure 4:
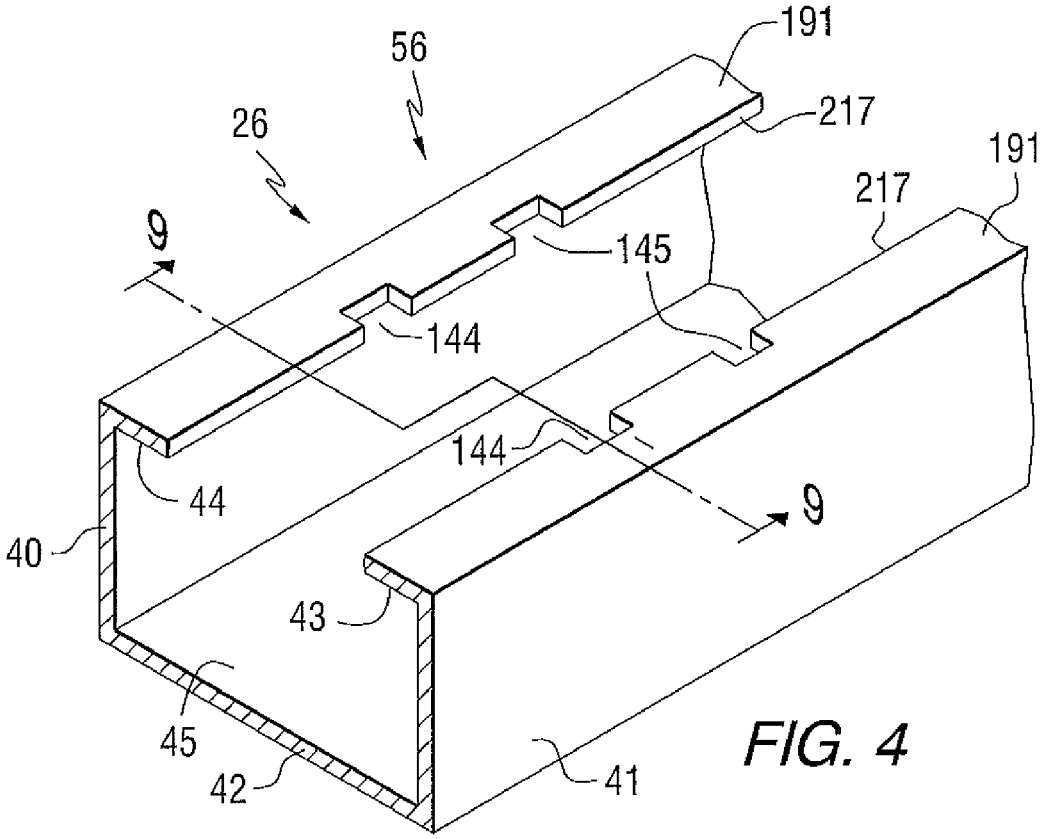
FIG. 4 is an orthogonal view of a section of a non-limiting embodiment of a spacer frame that can be used in the practice of the invention.

Although the invention is not limited to the design or construction of the spacer frame 26, in a preferred non-limiting embodiment of the invention, the spacer frame is an endless or close ended ("closed") spacer frame having an interior opening as shown by dotted lines 55 in FIG. 1, and made from a continuous piece of spacer stock having a U-shaped cross-section as shown in FIGS. 2 and 3 and as shown in FIG. 4 for the segment 56 of the spacer frame 26. A detailed discussion of spacer stocks having U-shaped cross-sections is presented, among other places, in U.S. Pat. Nos. 5,177,916 and 5,531,047, which disclosures are hereby incorporated by reference.

Figure 5:
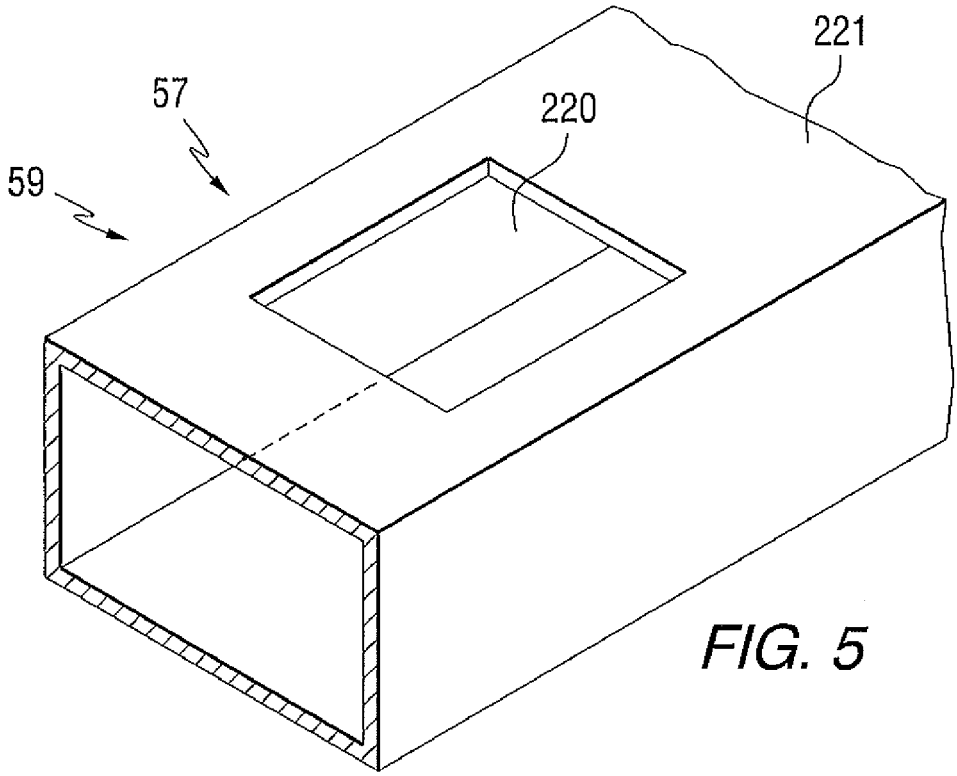
FIG. 5 is a view similar to the view of FIG. 4 showing a section of another non-limiting embodiment of a spacer frame that can be used in the practice of the invention.

As can be appreciated, the invention is not limited to a spacer frame made from a continuous strip or piece of spacer stock, and the spacer frame can be made from spacer sections joined together by corner keys or welding, e.g., as disclosed in U.S. patent application Ser. No. 11/696,377. Still further, the invention is not limited to the cross sectional shape of the spacer frame, and the spacer frame can have any cross sectional shape, e.g. and not limiting to the invention, the spacer frame can have a quadrilateral cross sectional shape as shown in FIG. 5 for the segment 57 of spacer frame 59.

With continued reference to FIGS. 2 and 3, a bead 60 of a moisture-pervious adhesive material having a desiccant 61 therein, e.g. but not limiting to the invention, a desiccant impregnated polyurethane bead is on the inner surface 45 of the base 42 of the spacer frame 26 to adsorb moisture trapped in the sealed compartment 36 during fabrication of the unit 20. For a more detailed discussion of desiccant impregnated moisture-pervious adhesives, reference can be made to U.S. Pat. Nos. 5,177,916; 5,531,047 and 5,655,282; U.S. Patent Publication No. US2005/0028459A1 and U.S. patent application Ser. No. 11/696,377 which documents are hereby incorporated by reference.

With continued reference to FIG. 1, elongated vertical members 70 and elongated horizontal member 72 are joined together in any usual manner to form the grid 39 simulating muntins. Fabricating grids simulating muntins is well known to those skilled in the art of fabricating multi-sheet glazing units, and the manner for fabricating the grid is not limiting to the invention. A discussion of the particulars for forming a grid simulating muntins is well known in the art and is not presented herein.

The vertical and the horizontal members 70 and 72, respectively, have shaped ends 74 (see FIGS. 3 and 6-9) that engage the extensions 43 and 44 of the spacer frame in a manner discussed below to position the grid 39 simulating muntins within the spacer frame 26, between the sheets 22 and 24, in the compartment 36. With reference to FIG. 4, in one non-limiting embodiment of the invention, the extensions 43 and 44 of the spacer frame 26 are each provided with a pair of spaced notches 144 and 145 for receiving one of the shaped ends 74 of the vertical or horizontal member 70 and 72, respectively to detachably secure the shaped end 74 to the spacer frame 26 in a manner discussed below.

Figure 6:
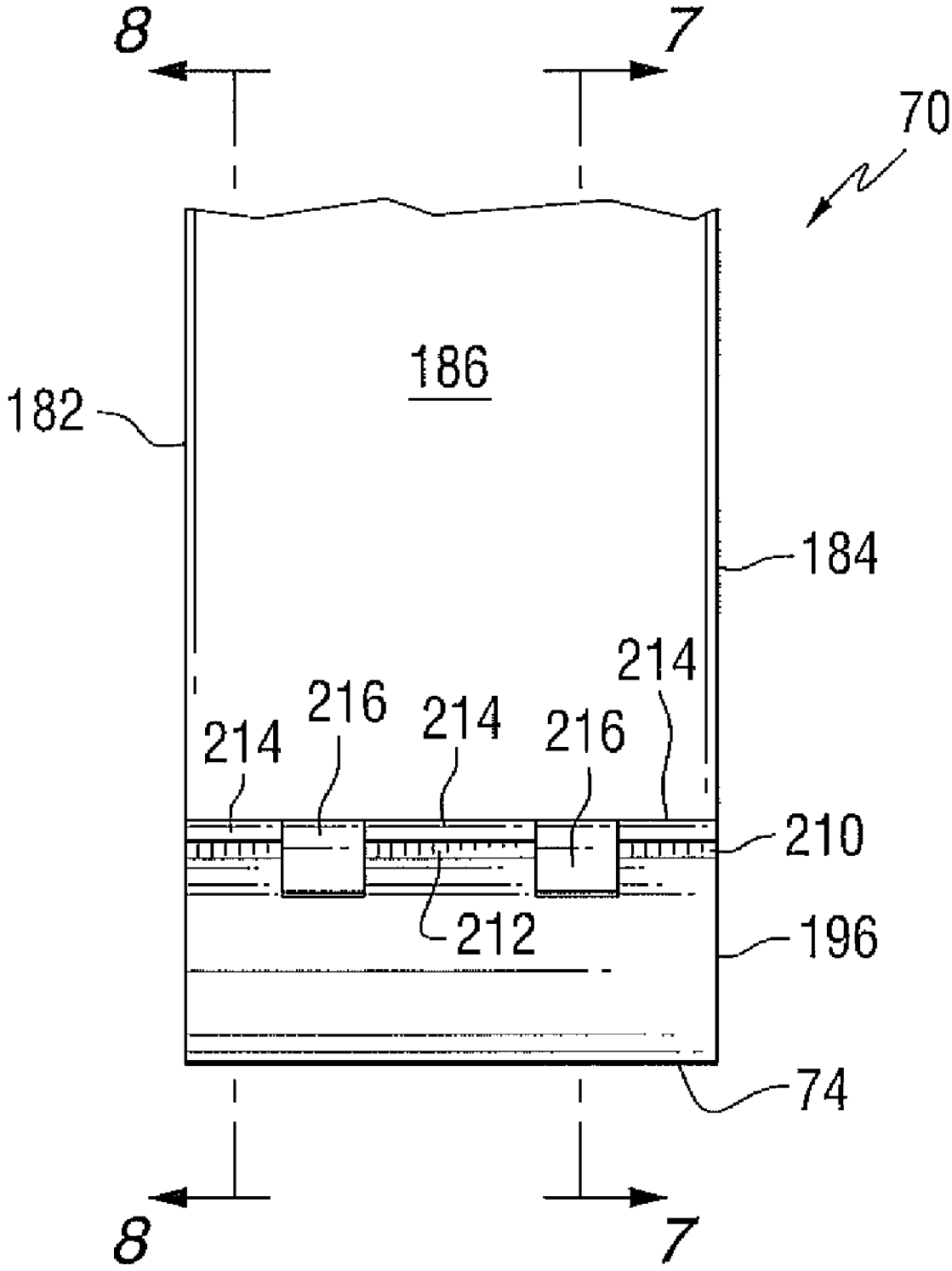
FIG. 6 is front view of an end section of an elongated member of a grid simulating muntins, the elongated member incorporating features of the invention.
Figure 7:
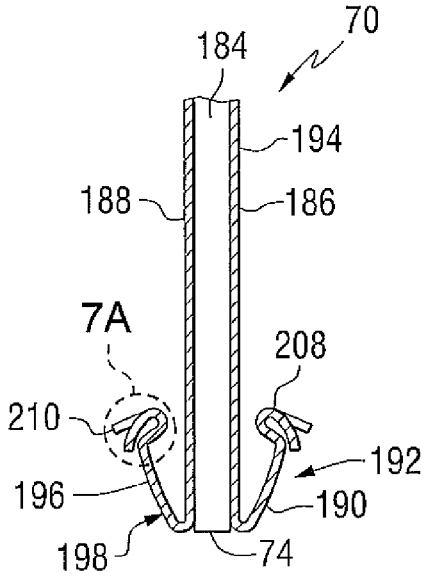
FIG. 7 is a view taken along lines 7-7, of FIG. 6.
Figure 8:
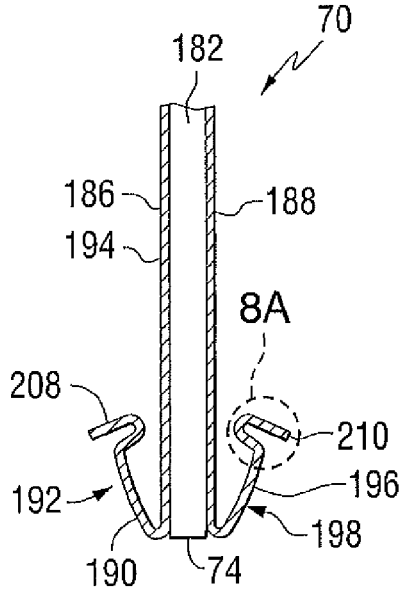
FIG. 8 is a view taken along lines 8-8, of FIG. 6.

The discussion of the invention is directed to the vertical elongated member 70 of the grid 39 with the understanding that the discussion is applicable to the horizontal elongated member 72 unless indicated otherwise. With reference to FIGS. 6-8, as needed, the elongated vertical member 70 includes a first side 182, an opposite second side 184, a third side 186 between the first and second sides 182 and 184, respectively, and an opposite fourth side 188 with the sides joined together to form the vertical elongated member 70. Although not limiting to the invention, the sides 182 and 184 have a width less than the width of the sides 186 and 188, and are also referred to as the minor sides 182 and 184, and the sides 186 and 188 are also referred to as the major sides 186 and 188. As is appreciated by those skilled in the art, the vertical and the horizontal members 70 and 72, respectively, are hollow metal tubing having a baked coating on the outer surface and a rectangular cross section. The invention, however, is not limited thereto, and the elongated members 70 and 72 can have any cross sectional shape, e.g. but not limited to circular, elliptical, a polygon having 3 or more straight or radiused sides, and combinations thereof. Further, the elongated members can be made of any material, e.g. but not limited to coated or uncoated metal, wood, plastic, fiber reenforced plastic and combinations thereof. Still further in the practice of the invention, the elongated members can have a solid center portion with hollow end portions.

In one non-limiting embodiment of the invention, each shaped end 74 of the vertical and horizontal elongated members 70 and 72, respectively, is shaped to engage the extensions 43 and 44 (see FIGS. 2-4) of the spacer frame 26 to position the grid 39 in the interior of the spacer frame in accordance to the teachings of the invention. The following discussion of the shaped end 74 of the elongated members 70 and 72 of the invention is directed to the shaped end 74 of the vertical elongated member 70 shown in FIGS. 6-8 with the understanding that the discussion is applicable, unless indicated otherwise to the opposite end of the vertical elongated member 70, and is applicable, unless indicated otherwise, to each of the opposite shaped ends of the horizontal elongated member 72. In this non-limiting embodiment of the invention, the major sides 186 and 188 of the elongated members 70 and 72 of the grid 39 are in facing relationship to the adjacent one of the glass sheets 22 and 24, respectively (see FIG. 2) and the minor sides 182 and 184 face the sides of the spacer frame 26. With reference to FIGS. 6-8 as needed, the shaped end 74 includes end part or segment 190 of the major side 186 bent in relationship to the major side 186 to form a V-shaped member 192 and end part or segment 196 of the major side 188 bent in relationship to the major side 188 to form a V-shaped member 198 as shown in FIGS. 7 and 8. In this non-limiting embodiment of the invention, the elongated vertical and horizontal members 70 and 72, respectively, are made of metal, and the end segment 190 of the V shaped member 192, and the end segment 196 of the V shaped member 198 are moveable toward one another against the internal biasing action of the metal.

Figure 7A:
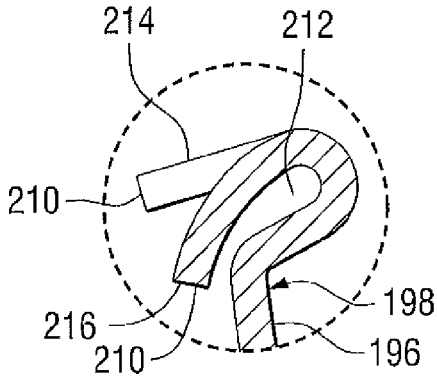
FIG. 7A is an enlarged view of the circled portion of FIG. 7.
Figure 8A:
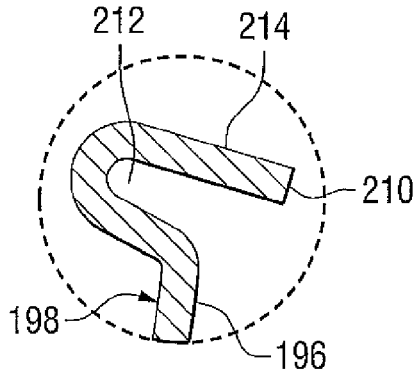
FIG. 8A is an enlarged view of the circled portion of FIG. 8.
Figure 9:
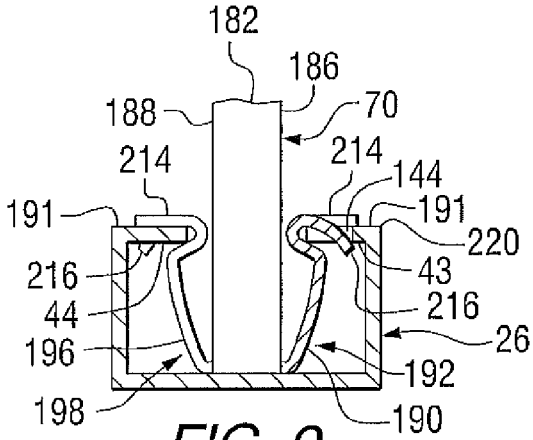
FIG. 9 is a view along lines 9-9 of FIG. 4 showing the elongated member of FIG. 6 mounted on the section of the spacer frame shown in FIG. 4.

With reference to FIGS. 6-8, 7A and 8A as needed, end portion 208 of the end part or segment 190, and end portion 210 of the end segment 196 each have a hooked shaped end to have a groove 212, a ledge portion 214 and one or more spaced bent tabs 216 (clearly shown in FIG. 7A). The groove 212 receives edge portion 217 of the extensions 43 and 44 of the spacer frame 26 (see FIG. 4) with the ledge portion 214 resting on the outer surface 191 of the extensions 43 and 44. In this manner, the ends 74 of the elongated members 70 and 72 are maintained at a spaced predetermined distance from the inner surface 45 of the base 42 of the spacer frame 26. The bent portions or tabs 216 are received in the cut outs 144 and 145 in the extensions 43 and 44 of the spacer frame 26. In this manner the elongated members 70 and 72 of the grid 39 are maintained in a predetermined position in the spacer frame 26.

With reference to FIGS. 4, 7A, 8A and 9, in one non-limiting embodiment of the invention, the shaped ends 74 of the elongated vertical and horizontal members 70 and 72 are inserted between the extensions 43 and 44 of the spacer frame 26. As the end segments 190 and 196 of the elongated members 70 and 72 move between the extensions 43 and 44 of the spacer frame 26, the end segments 190 and 196 move toward one another against the internal biasing action of the material of the elongated member. Continued movement of the end 74 between the extensions 43 and 44 moves the tabs 216 of the end segments 190 and 196 into the cut outs 144 and 145 (see FIG. 4), and the ledge portions 214 onto the surface 191 of the extensions 43 and 44. The shaped end portions 74 of the elongated vertical and horizontal members 70 and 72, respectively, are secured between the extensions 43 and 44. As can be appreciated, the invention is not limited to the number of bent portions or tabs 216 provided on the end portion 190 and 196, of the elongated members 70 and 72, and the invention contemplates no bent portions 216 to as many as desired. For example and with reference to FIG. 5, hole 220 in surface 221 of the spacer frame 59 can be used to maintain the position of the elongated members 70 and 72 eliminating the need for the cut outs 144 and 145 (see FIG. 4) and the bent portions 216 (see FIGS. 7A and 9).

The invention is not limited to the manner in which the end segments 190 and 196 of the major sides 186 and 188, respectively of the elongated vertical and horizontal members 70 and 72, respectively, are shaped and any shaping or forming technique can be used in the practice of the invention. With reference to FIGS. 10-13 as needed, the discussion is directed to one non-limiting embodiment of the invention for shaping the end segments 190 and 196 of the major sides 186 and 188, respectively, of the elongated members 70 and 72. In the following discussion the shaped ends of the vertical elongated member 70 are formed, and the discussion is applicable unless indicated otherwise to the shaping of the ends of the horizontal members 72.

Figure 13:
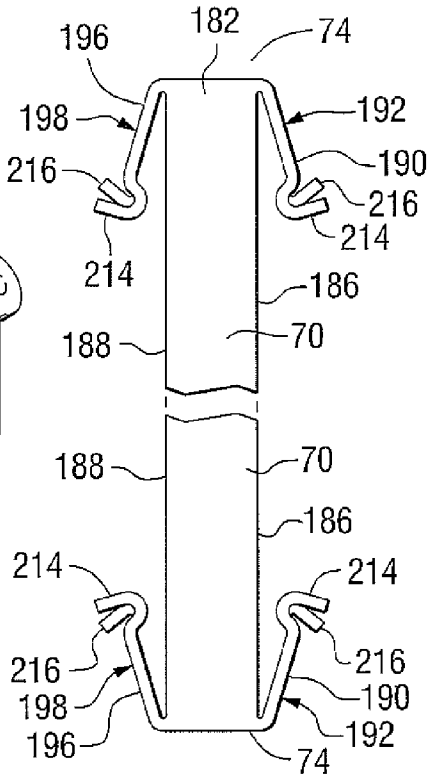
FIGS. 10-13 are different views showing non-limiting configurations of the end section of an elongated member of a grid of the invention after the practice of non-limiting operations of the invention to shape the end of the member in accordance to the teachings of the invention.
Figure 12:
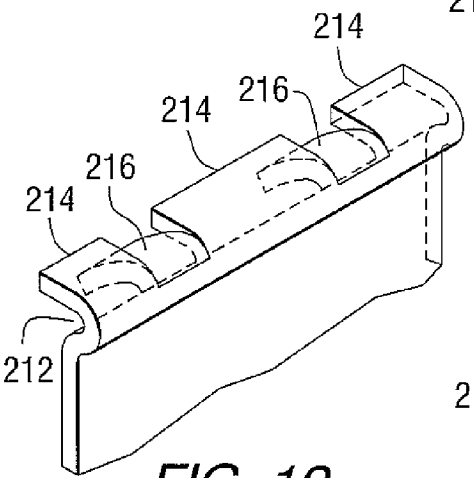
Figure 11:
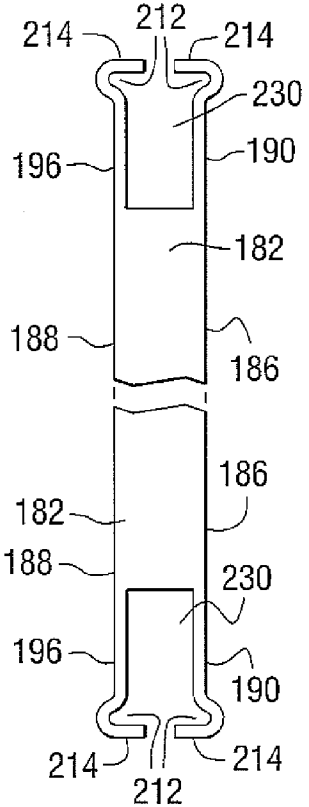
Figure 10:
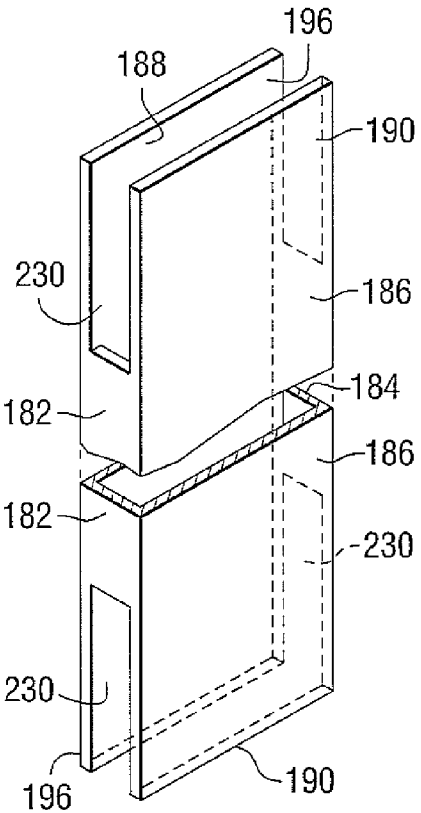

A length of an elongated member greater than the spaced distance between opposed sides of the spacer frame 26 is cut. The length is sufficient to provide the ends 74 with the V-shaped members 192 and 198 (see FIG. 13) fitting between the extensions 43 and 44 to position the ends 74 of the elongated members 70 and 72 out of the sight line. End portion of the minor sides 182 and 184 of the elongated member 70 is removed to provide a void 230. The groove 212 and ledge portion 214 (see FIG. 11) are formed on each end of the end segments 190 and 196 with the grooves 212 at their respective end of the elongated member 70 facing one another. Spaced segments of the ledge 214 are cut and bent toward the groove 212 to provide the bent portions 216 between the ledge portions 214 (see FIGS. 7A and 12). The end segments 190 and 196 are bent to form the V shaped members 192 and 198, respectively, at each end of the elongated member 70 as shown in FIG. 13. The invention is not limited to the sequence of operations discussed above and any sequence can be practiced, e.g. and not limiting to the invention, the V shaped members 192 and 198 can be formed before the groove 212 is formed, or the V shaped members can be formed after the groove is formed and before the bent portions 216 between the ledge portions 214 are formed.

The elongated vertical and horizontal members 70 and 72 of the grid 39 are joined together in any usual manner, and the shaped ends 74 of the elongated vertical and horizontal members 70 and 72, respectively of the grid 39 are mounted between the outer legs 40 and 41 of the spacer frame 26 as discussed above. The elongated vertical and horizontal members 70 and 72 of the grid 39 are hollow and flexible and are easily flexed to pass the shaped ends 74 of the members 70 and 72 between the extensions 43 and 44 of the spacer frame 26 to mount the grid 39 within the spacer frame 26. More particularly, and as is appreciated by those skilled in the art, the grid 39, the outer legs 40 and 41 of the spacer frame 28, and the sides of the spacer frame are flexible so that the grid 39 can be mounted within the closed ended spacer frame as discussed above; however, in those instances when the grid 39 and the spacer frame 26 do not provide sufficient flexibility, a corner of the spacer frame 26 can be left open, and after the grid is mounted within the spacer frame, the open end closed.

The above discussion presented several embodiments of the invention, however, the scope of the invention is not limited thereto, and the scope of the invention is only limited by the scope of the following claims.

What is claimed is:

1. A grid simulating muntins, the grid comprising a first plurality of spaced elongated members connected to a second plurality of spaced elongated members, wherein one of the elongated members of the first plurality of spaced elongated members defined as the first elongated member comprises:

a first side having a length, an outer surface, a first end and an opposite second end, the first side continuous along its length from the first end to the second end of the first side;

a second side having a length, an outer surface, a first end and an opposite second end, the second side continuous along its length from the first end to the second end of the second side;

a third side having a length and connected to the first and the second sides;

a fourth side opposite the third side, the fourth side having a length and connected to the first and the second sides, wherein the length of the first side and the length of the second side are each greater than the length of the third side and the length of the fourth side; the first side, the second side, the third side and the fourth side are connected such that connected portions of the first side, the second side, the third side and the fourth side of the first elongated member (1) have the second side opposite to the first side; (2) have the outer surface of the second side facing away from the outer surface of the first side, and (3) have the first end of the first side and the first end of the second side adjacent to one another;

the first side having a first end portion, the first end portion attached directly to the first end of the first side, and the second side having a second end portion, the second end portion attached directly to the first end of the second side, wherein the first end portion and the second end portion are spaced from one another, such that (a) the first end portion is movable in a first direction to position the first end portion over the outer surface of the first side and in an opposite second direction away from the outer surface of the first side, (b) the second end portion is moveable in a first direction over the outer surface of the second side and in an opposite second direction away from the outer surface of the second side, and (c) the first end portion and the second end portion are simultaneously moveable in their respective first direction;

the first end portion and the second end portion each have a ledge, each said ledge having a first end connected to said first and second end portions, respectively, and a second end distal to said first end, said second end defining a groove configured to receive an extension that is substantially perpendicular to the first and second sides of said first elongated member, said distal end of said groove having a first member configured to rest on an upper surface of said extension, and a second member configured to abut a groove in said extension resulting in restricted movement of the first elongated member in the longitudinal direction of said extension.

2. The grid according to claim 1 wherein the connected portions of the first side, the second side, the third side and the fourth side of the first elongated member form a hollow, open-ended, continuous, passageway.

3. The grid according to claim 1, wherein the first side, the second side, the third side and the fourth side are connected such that connected portions of the first side, the second side, the third side and the fourth side of the first elongated member has a four sided cross-section.

4. The grid according to claim 1, wherein the first side, the second side, the third side and the fourth side are connected such that connected portions of the first side, the second side, the third side and the fourth side of the first elongated member have the second end of the first side and the second end of the second side adjacent to one another;

the first side having a third end portion, the third end portion opposite to the first end portion and attached directly to the second end of the first side, and the second side having a fourth end portion, the fourth end portion is opposite to the second end portion and attached directly to the second end of the second side, wherein the third end portion and the fourth end portion are spaced from one another, such that (a) the third end portion is movable in a first direction to position the third end portion over the outer surface of the first side and in an opposite second direction away from the outer surface of the first side, (b) the fourth end portion is moveable in a first direction over the outer surface of the second side and in an opposite second direction away from the outer surface of the second side, and (c) the third end portion and the fourth end portion are simultaneously moveable in their respective first direction, and the third end portion and the fourth end portion each have a ledge, each said ledge having a first end connected to said third and fourth end portions, respectively, and a second end distal to said first end, said second end defining a groove configured to receive an extension that is substantially perpendicular to the first and second sides of said first elongated member, said distal end of said groove having a first member configured to rest on an upper surface of said extension, and a second member configured to abut a groove in said extension resulting in restricted movement of the first elongated member in the longitudinal direction of said extension.

5. The grid according to claim 4, wherein each of the remaining ones of the elongated members of the first plurality of elongated members and each of the second plurality of elongated members have first, second, third and fourth end portions corresponding in shape to the first, second, third, and fourth end portions of the first elongated member.

6. A multi-sheet unit comprising:

a spacer frame having a base, a pair of legs extending from the base toward an interior of the spacer frame, and an interior side facing the interior of the spacer frame;

a first sheet mounted on an outer surface of one of the legs of the pair of legs and a second sheet mounted on an outer surface of the other one of the pair of legs;

a grid simulating muntins in the interior of the spacer frame between the sheets, the grid comprising a first plurality of spaced elongated members, and a second plurality of spaced elongated members, wherein each of the first plurality of elongated members and each of second plurality of elongated members comprises:

a first side having a length, an outer surface, a first end and an opposite second end, the first side continuous along its length from the first end to the second end of the first side;

a second side having a length, an outer surface, a first end and an opposite second end, the second side continuous along its length from the first end to the second end of the second side;

a third side having a length and connected to the first and the second sides;

a fourth side opposite the third side, the fourth side having a length and connected to the first and the second sides, wherein the length of the first side and the length of the second side are each greater than the length of the third side and the length of the fourth side; the first side, the second side, the third side and the fourth side are connected such that connected portions of the first side, the second side, the third side and the fourth side of the first elongated member (1) have the second side opposite to the first side; (2) have the outer surface of the second side facing away from the outer surface of the first side, (3) have the first end of the first side, and the first end of the second side adjacent to one another and (4) have the second end of the first side, and the second end of the second side adjacent to one another;

the first side having a first end portion and a second end portion, the first end portion attaching directly to the first end of the first side and the second end portion attaching directly to the second end of the first side, and the second side having a third end portion and a fourth end portion, the third end portion attaching directly to the first end of the second side and the fourth end portion attaching directly to the second end of the second side, wherein the first end portion and the third end portion are spaced from one another, such that (a) the first end portion is movable in a first direction to position the first end portion over the outer surface of the first side and in an opposite second direction away from the outer surface of the first side, (b) the third end portion is moveable in a first direction over the outer surface of the second side and in an opposite second direction away from the outer surface of the second side, and (c) the first end portion and the third end portion are simultaneously moveable in their respective second direction, and the second end portion and the fourth end portion are spaced from one another, such that (d) the second end portion is movable in a first direction to position the second end portion over the outer surface of the first side and in an opposite second direction away from the outer surface of the first side, (e) the fourth end portion is moveable in a first direction over the outer surface of the second side and in an opposite second direction away from the outer surface of the second side, and (f) the third end portion and the fourth end portion are simultaneously moveable in their respective first direction;

the first end portion, the second end portion, the third end portion and the fourth end portion each have a ledge, wherein the ledge of the first end portion and the ledge of the third end portion of each of the first plurality of elongated members engages a first length of the interior side of the spacer frame; the ledge of the second end portion and the ledge of the fourth end portion of each of the first plurality of elongated members engages a second length of the interior side of the spacer frame, the second length of the interior side of the spacer frame opposite to the first length of the interior side of the spacer frame, and wherein the ledge of the first end portion and the ledge of the third end portion of each of the second plurality of the elongated members engages a third length of the interior side of the spacer frame, wherein the third length of the interior side of the spacer frame is between the first length, and the second length, of the interior side of the spacer frame, and the second end portion and the fourth end portion of each of the second plurality of elongated members engages a fourth length of the interior side of the spacer frame, the fourth length of the interior side of the spacer frame between the first and the second lengths of the interior sides of the spacer frame and opposite to the third length of the interior side of the spacer frame.

7. The multi-sheet unit according to claim 6 wherein the sheets are selected from the group of glass sheets, plastic sheets, coated sheets, laminated sheets and opaque sheets.

8. The multi-sheet unit grid according to claim 6, wherein the first side, the second side, the third side and the fourth side are connected such that connected portions of the first side, the second side, the third side and the fourth side of the first elongated member has a four sided cross-section.

9. The multi-sheet unit according to claim 6 wherein each of the first, second, third and fourth end portions of each of the first and the second plurality of elongated members has a groove and each of the grooves has an opening;

the first end portion of each of the first plurality and the second plurality of elongated members is over the outer surface of the first side of its respective one of the first plurality and the second plurality of elongated members, the second end portion of each of the first and the second plurality of elongated members is over the outer surface of the first side of its respective one of the first plurality and the second plurality of elongated members, the third end portion of each of the first and the second plurality of elongated members is over the outer surface of the second side of its respective one of the first plurality and the second plurality of elongated members, and the fourth end portion of each of the first and the second plurality of elongated members is over the outer surface of the second side of its respective one of the first plurality and the second plurality of elongated members, and a portion of the first length of the interior side of the spacer frame is in the groove of the first end portion and the third end portion of the first plurality of elongated members, a portion of the second length of the interior side of the spacer frame is in the groove of the second end portion and the fourth end portion of the first plurality of elongated members, a portion of the third length of the interior side of the spacer frame is in the groove of the first end portion and the third end portion of the second plurality of elongated members, and a portion of the fourth length of the interior side of the spacer frame is in the groove of the second end portion and the fourth end portion of the second plurality of elongated members.

10. The multi-sheet unit according to claim 6 wherein one of the pair of legs of the spacer frame is a first leg and the other one of the pair of legs of the spacer frame is a second leg, and the interior side of the spacer frame comprises a first extension connected to the first leg and a second extension connected to the second leg, wherein the first and second extensions extend over the inner surface of the base toward one another and terminate short of one another, and wherein the ledges of the first end portions of the first plurality of elongated members contact an outer surface of the first extension of the first length of the spacer frame; the ledges of the third end portions of the first plurality of elongated members contact an outer surface of the second extension of the first length of the spacer frame; the ledges of the second end portions of the first plurality of elongated members contact an outer surface of the first extension of the second length of the spacer frame; and the ledges of the fourth end portions of the first plurality of elongated members contact an outer surface of the second extension of the second length of the spacer frame, and wherein the ledges of the first end portions of the second plurality of elongated members contact an outer surface of the first extension of the third length of the spacer frame; the ledges of the third end portions of the second plurality of elongated members contact an outer surface of the second extension of the third length of the spacer frame; the ledges of the second end segments of the second plurality of elongated members contact an outer surface of the first extension of the fourth length of the spacer frame; and the ledges of the fourth end portions of the second plurality of elongated members contact an outer surface of the second extension of the fourth length of the spacer frame.

11. The multi-sheet unit according to claim 10, wherein each of the first, second, third and fourth end portions of the first plurality and the second plurality of elongated members has a groove with opening of the grooves of the first and the second end portions of the first plurality and the second plurality of elongated members facing away from the outer surface of the first side of its respective elongated member and the opening of the grooves of the third and fourth end portions facing away from the outer surface of the second side of its respective elongated member;

portions of the first extension of the first length of the spacer frame extend into the grooves of the first end portions of the first plurality of elongated members, portions of the second extension of the first length of the spacer frame extend into the grooves of the third end portions of the first plurality of elongated members, portions of the first extension of the second length of the spacer frame extend into the grooves of the second end portions of the first plurality of elongated members, and portions of the second extension of the second length of the spacer frame extend into the grooves of the fourth end portions of the first plurality of elongated members, and portions of the first extension of the third length of the spacer frame extend into the grooves of the first end portions of the second plurality of elongated members; portions of the second extension of the third length of the spacer frame extend into the grooves of the third end portions of the second plurality of elongated members, portions of the first extension of the fourth length of the spacer frame extend into the grooves of the second end portions of the second plurality of elongated members, and portions of the second extension of the fourth length of the spacer frame extend into the grooves of the fourth end portions of the second plurality of elongated members.

12. The multi-sheet unit according to claim 11 wherein the first extensions of the first length, the second length, the third length and the fourth length of the spacer frame have a first plurality of spaced set of notches and the second extensions of the first length, second length, third length and fourth length of the spacer frame have a second plurality of spaced set of notches, and each one of the first end portions, the second end portions, the third end portions and the fourth end portions of the first and second plurality of elongated members has a portion of the ledge bent over their respective groove defined as a bent portion, and selected ones of the bent portions of the first end portions of the first plurality and the second plurality of elongated members are in selected ones of first plurality of spaced set of notches in the first extension of the first length and of the third length of the spacer frame; selected ones of the bent portions of the second end portions of the first plurality and the second plurality of elongated members are in selected ones of the first plurality of spaced set of notches in the first extension of the second length and the fourth length of the spacer frame; selected ones of the bent portions of the third end portions of the first plurality and second plurality of elongated members are in selected ones of the spaced second set of notches in the second extension of the first length and the second length of the spacer frame, and selected ones of the bent portions of the fourth end portions of the first plurality and the second plurality of elongated members are in selected ones of the spaced second set of notches in the second extension of the second and fourth lengths of the spacer frame.

13. The multi-sheet unit according to claim 12 wherein the spacer frame has four sides, the first length of the spacer frame is at a first side of the spacer frame, the second length is at a second side of the spacer frame, the third length is at a third side of the spacer frame and the fourth length is at a fourth side of the spacer frame and the first plurality of elongated members extend from the first side of the spacer frame to the opposite second side of the spacer frame, and the second plurality of elongated members extend from the third side of the spacer frame to the opposite fourth side of the spacer frame.

14. The multi-sheet unit according to claim 13 wherein a first portion of the outer surface of the first side and a first portion of the outer surface of the second side of the first plurality of elongated members is between the extensions of the first side of the spacer frame and the inner surface of the base of the first side of the spacer frame; a second portion of the outer surface of the first side and a second portion of the outer surface of the second side of the first plurality of elongated members is between the extensions of the second side of the spacer frame and the inner surface of the base of the second side of the spacer frame; a first portion of the outer surface of the first side and a first portion of the outer surface of the second side of the second plurality of elongated members is between the extensions of the third side of the spacer frame and the inner surface of the base of the third side of the spacer frame; a first portion of the outer surface of the first side and a first portion of the outer surface of the second side of the second plurality of elongated members is between the extensions of the fourth side of the spacer frame and the inner surface of the base of the fourth side of the spacer frame.

* * * * *